US012264906B2

(12) United States Patent
Biard

(10) Patent No.: US 12,264,906 B2
(45) Date of Patent: Apr. 1, 2025

(54) FIRING METHOD FOR A SET OF ELECTRONIC DETONATORS AND ASSOCIATED ELECTRONIC DETONATOR

(71) Applicants: Commissariat A L'Energie Atomique et Aux Energies Alternatives, Paris (FR); DAVEY BICKFORD, Hery (FR)

(72) Inventor: Lionel Biard, Grenoble (FR)

(73) Assignees: COMMISSARIAT A L'ENERGIE ATOMIQUE ET AUX ENERGIES ALTERNATIVES, Paris (FR); DAVEY BICKFIRD, Hery (FR)

( * ) Notice: Subject to any disclaimer, the term of this patent is extended or adjusted under 35 U.S.C. 154(b) by 144 days.

(21) Appl. No.: 17/413,811

(22) PCT Filed: Dec. 17, 2019

(86) PCT No.: PCT/FR2019/053118

§ 371 (c)(1),
(2) Date: Jun. 14, 2021

(87) PCT Pub. No.: WO2020/128300

PCT Pub. Date: Jun. 25, 2020

(65) Prior Publication Data

US 2022/0018644 A1 Jan. 20, 2022

(30) Foreign Application Priority Data

Dec. 17, 2018 (FR) ..... 1873012

(51) Int. Cl.
*F42D 1/055* (2006.01)

(52) U.S. Cl.
CPC ..... *F42D 1/055* (2013.01)

(58) Field of Classification Search
CPC ..... F42D 1/045; F42D 1/05; F42D 1/055
(Continued)

(56) References Cited

U.S. PATENT DOCUMENTS 4,777,880 A 10/1988 Beattie et al.
7,054,131 B1 * 5/2006 Kanth ..... F42D 1/055 361/247

(Continued)

FOREIGN PATENT DOCUMENTS

CN 101135904 A 3/2008
CN 101308007 A 11/2008

(Continued)

OTHER PUBLICATIONS

A4.

(Continued)

*Primary Examiner* — Joshua E Freeman
*Assistant Examiner* — Benjamin S Gomberg
(74) *Attorney, Agent, or Firm* — Crowell & Moring LLP

(57) ABSTRACT

A firing method for a set of electronic detonators includes receipt, by a receiving device associated with one or more electronic detonators, of an ignition command from a transmitted sequence of ignition commands including at least two ignition commands, a synchronisation delay being associated with each ignition command. A counting down, from the time of receipt of the ignition command, of the synchronisation delay associated with the received ignition command, and a counting down of an ignition delay associated with each electronic detonator from a synchronisation time corresponding to the time at which the countdown of the synchronisation delay is complete, are carried out. Each electronic detonator is ignited once the countdown of the ignition delay is complete. An electronic detonator includes a reception device, first and second countdown devices and a firing device.

19 Claims, 4 Drawing Sheets

(58) Field of Classification Search
USPC ..... 102/217
See application file for complete search history.

(56) References Cited

U.S. PATENT DOCUMENTS

| | | | | |
|---|---|---|---|---|
| 7,086,334 | B2 * | 8/2006 | Jennings, III | F42D 1/055 320/155 |
| 7,848,078 | B2 * | 12/2010 | Hummel | F42D 3/04 361/247 |
| 2003/0136289 | A1 * | 7/2003 | Hallin | F42D 1/055 102/200 |
| 2008/0282925 | A1 * | 11/2008 | Lownds | F42D 3/04 702/14 |
| 2009/0193993 | A1 * | 8/2009 | Hummel | F42D 1/055 901/50 |
| 2010/0005994 | A1 * | 1/2010 | Jacobson | F42B 1/02 102/215 |
| 2012/0174809 | A1 * | 7/2012 | Stewart | F42D 1/055 102/215 |
| 2015/0007740 | A1 * | 1/2015 | Guyon | F42D 1/06 102/215 |
| 2017/0074630 | A1 * | 3/2017 | Kotsonis | F42D 1/05 |
| 2018/0306564 | A1 * | 10/2018 | Dinn | F42D 1/06 |

FOREIGN PATENT DOCUMENTS

| | | | |
|---|---|---|---|
| CN | 201488669 | U | 5/2010 |
| CN | 101813445 | A | 8/2010 |
| CN | 101886901 | A | 11/2010 |
| CN | 105509580 | A | 4/2016 |
| CN | 108474637 | A | 8/2018 |
| WO | WO 01/67031 | A1 | 9/2001 |
| WO | WO 2005/052498 | A1 | 6/2005 |
| WO | WO 2006/076777 | A1 | 7/2006 |
| WO | WO 2012/061850 | A1 | 5/2012 |

OTHER PUBLICATIONS

Chinese Office Action and English translation thereof from corresponding Chinese Application No. 201980090250, Aug. 18, 2022, pp. 1-18.

* cited by examiner

Fig. 1a
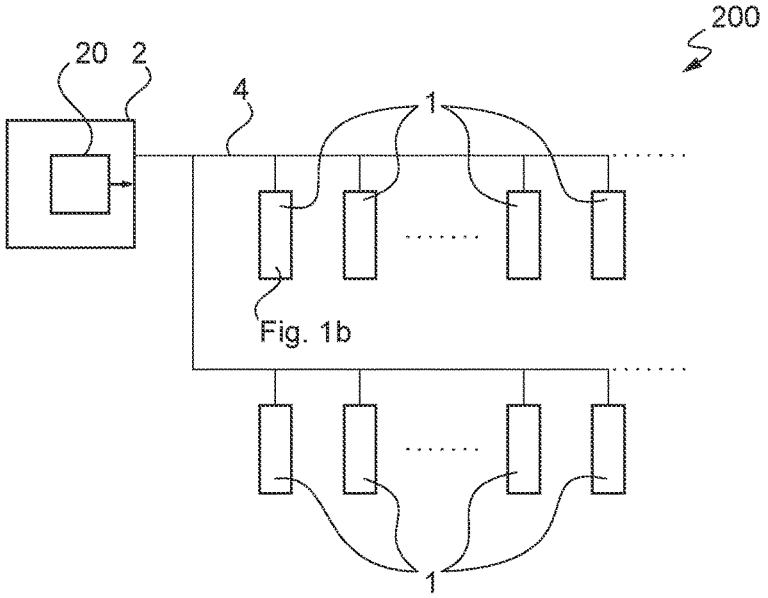
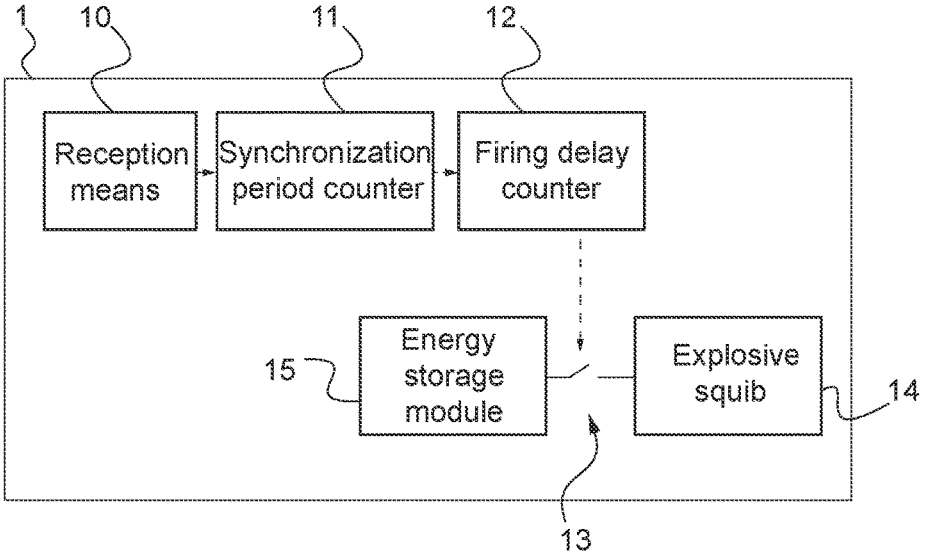
Fig. 1b

Fig. 3
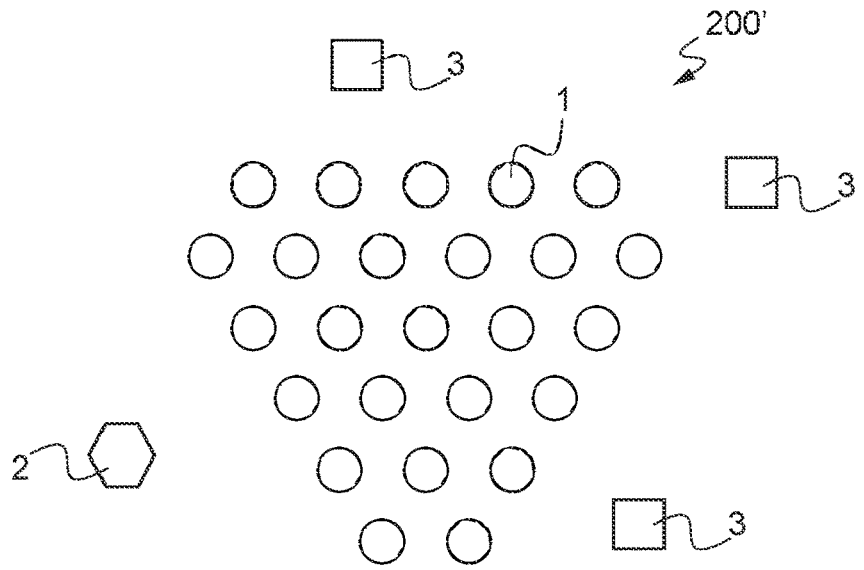
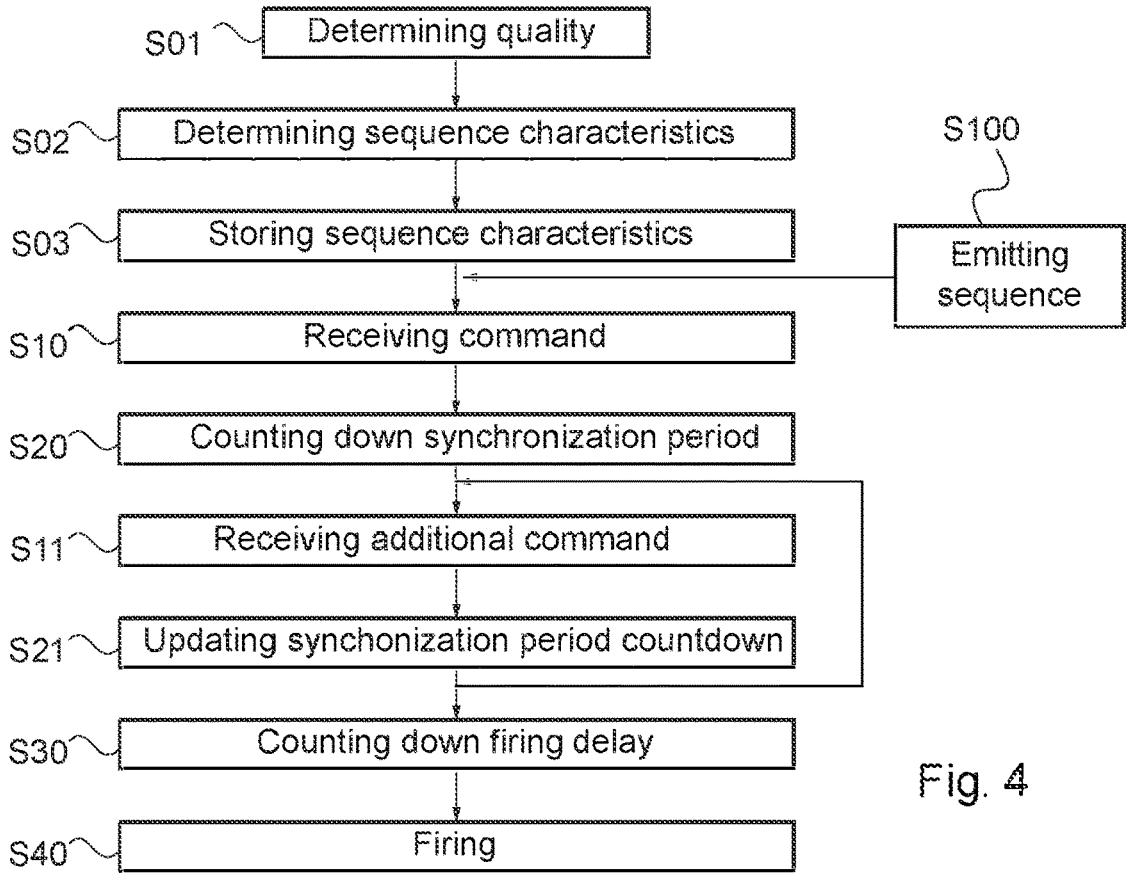
Fig. 4

FIRING METHOD FOR A SET OF ELECTRONIC DETONATORS AND ASSOCIATED ELECTRONIC DETONATOR

RELATED APPLICATIONS

This application is a 35 U.S.C. 371 nationalization of published PCT application no. PCT/FR2019/053118, filed Dec. 17, 2019, which claims priority to French patent application no. 1873012, filed Dec. 17, 2018, the contents of which are incorporated by reference.

TECHNICAL FIELD

The present invention concerns a firing method for a set of electronic detonators.

The invention also concerns an electronic detonator, an emitter device, and a firing system for a set of electronic detonators.

BACKGROUND

The invention finds its application in the field of pyrotechnic initiation, in any sector in which a network of several electronic detonators must conventionally be implemented. Typical examples concern the exploitation of mines, quarries, seismic exploration, and the sector of building construction and public works.

On installing the firing system on the deployment site or worksite, the electronic detonators are installed respectively in locations arranged to receive them and which are charged with explosive. These locations are for example holes bored in the ground. The firing of the electronic detonators is next carried out in a predetermined sequence.

To achieve this result, a firing delay is individually associated with each electronic detonator, and a common firing instruction is disseminated over the network of electronic detonators using a control console. This firing instruction or firing command makes it possible to trigger the countdown for the firing delay for the set of electronic detonators. As of reception of the firing instruction, each electronic detonator manages the countdown of the specific delay associated with it, as well as its own firing.

Conventionally, the electronic detonators being of wired type, they are linked to a control console by electric wires or cables. The cabling used to link the electronic detonators to the control console enables communication between the control console and the electronic detonators, for example to exchange with them commands or messages relating to diagnostics, and to send them the firing command.

Sometimes, a firing system comprises several firing consoles, disposed in the vicinity of the firing front, and linked respectively to several sets of electronic detonators. The firing consoles communicate, in general by wireless communication means, with a control console at a distance. This control console sends messages to the firing consoles linked to the electronic detonators, such as the firing command. In turn, each firing console sends messages to all the electronic detonators linked to it.

Sometimes the environment of deployment of the electronic detonators, as well as defects in the connecting components used may be at the origin of cabling defects (bad contact, leakage currents, etc.), leading to degradation in the electrical signals sent. Furthermore, the use of a high number of detonators connected to the same network of cables may lead to attenuations and distortions in the modulated electrical signals sent over the cables, which may sometimes make it difficult for the electronic detonators to demodulate the signals received from the control console.

Wireless electronic detonators are also known which enable the cabling between the network of detonators and the control console to be dispensed with, and thus to dispense with uncertainties linked to that cabling.

The communication between the control console and the electronic detonators may for example be made by radio waves.

For electronic detonators of this type, although they do not have the aforesaid difficulties relating to cabling, the communication between the control console and the electronic detonators is still subject to transmission uncertainties which are sometimes difficult to predict, such as temporal and spatial fading, or interference. These effects lead to high variations in the signal-to-noise ratio input to the demodulator, which may at times prevent the reception by the electronic detonators of messages coming from the control console.

Thus, both for wireless electronic detonators and for wireless electronic detonators, problems in the communication between the control console and the electronic detonators may arise.

The remote control console and the firing consoles linked to the electronic detonators also in general communicate by wireless communication means.

Thus, the communications between the firing consoles linked to the electronic detonators and the remote control console also present the aforementioned problems.

These problems influence the reception of the firing instruction from the detonators. Sometimes, the firing instruction is not received by some detonators, which are not therefore fired. This is considered as a system fault.

The present invention is directed to providing a method of firing a set of electronic detonators enabling the firing reliability to be improved.

In this connection, according to a first aspect, the present invention concerns a method of firing a set of electronic detonators, each electronic detonator having an associated firing delay.

According to the invention, the method comprises steps as follows:

- receiving, by a reception device associated with one or more electronic detonators, a firing command from among a sequence of emitted firing commands comprising at least two firing commands, a synchronization period being associated with each firing command;
- starting from the instant of receiving said firing command, performing countdown of the synchronization period associated with said received firing command;
- performing countdown of the firing delay associated with each electronic detonator starting from a synchronization instant corresponding to the instant at which the countdown of the synchronization period has been finalized; and
- firing each electronic detonator when the countdown of the firing delay has been finalized.

Thus, a sequence of firing commands is emitted, for example by a control console, such that at least one of the firing commands is received by a reception device.

Each firing command has an associated synchronization period, the duration represented by the countdown of the synchronization period being different for different firing commands. As a matter of fact, the duration represented by the countdown of the synchronization period depends on the instant at which the firing command is emitted, relative to the instant of synchronization concerned.

It will be noted that for the countdown of the synchronization period, the reception device takes into account the instant at which the firing command is received. As a matter of fact, as the time for propagation of the firing commands is negligible, the instant of emitting a firing command and the instant of receiving the command in the reception device, are similar.

The instant of synchronization is defined as the instant at which the countdown of the synchronization period has been finalized and starting from which the countdown of the firing delay associated with the electronic detonator is carried out. In other words, the synchronization period associated with a firing command makes it possible to obtain the synchronization instant by means of the countdown of the synchronization period starting from the reception of the firing command.

SUMMARY

In reality, a processing time elapses between the end of the countdown of the synchronization period and the instant at which the countdown of the firing delay associated with the electronic detonator is carried out. As this processing time is negligible, below in the description it is considered that the countdown of the time of delay associated with the detonator begins when the end of the countdown of the synchronization period has been reached.

This synchronization instant must be in common for the triggering the countdown of the firing delay for the totality of the electronic detonators. This is because, in order for the firing of all the detonators to be implemented in synchronized manner, it is very important for the countdown of the firing delays to begin in synchronized manner starting from that synchronization instant.

Therefore, the association of a synchronization period with each firing command of the sequence, makes it possible to obtain the synchronization instant whatever the firing command received.

Furthermore, the multiple firing commands emitted enable the reception device to increase the probability of receiving at least one firing command.

Therefore, the reliability of the reception of the firing information is improved, that is to say that the reliability of all the electronic detonators is improved, while maintaining good synchronization of the firing.

According to one feature, the receiving step is performed by a reception device which is associated with a single electronic detonator and which forms an integral part of the electronic detonator, the step of performing countdown of the synchronization period and the step of performing countdown of the firing delay being carried out by the electronic detonator.

Thus, in this embodiment the detonator comprises the reception device, the firing command being received by the electronic detonator. Therefore, the synchronization instant constitutes the instant at which the countdown of the synchronization period associated with the received firing command has been finalized.

It will be noted that the modules forming the electronic detonator may be placed in a same housing or in distinct housings. For example, in a possible embodiment, some modules, such as radio communication modules are placed in a housing separated from the rest of the modules of the detonator in order to be able to place the radio communication module out of the ground whereas the rest of the electronic detonator is located in a hole bored in the ground.

According to one feature, the receiving step is carried out by a reception device which is associated with several electronic detonators, the firing method further comprising a step of receiving the synchronization instant by each electronic detonator, the step of performing countdown of the synchronization period being carried out by the reception device, and the step of performing countdown of the firing delay being carried out by each electronic detonator, after receiving the synchronization instant.

In this embodiment, once the countdown of the synchronization period associated with the received firing command has been finalized, the reception device sends the synchronization instant obtained to the associated electronic detonators in order for them to begin the countdown of the firing delay.

It will be noted that the countdown of the firing delay in a detonator does not begin until the synchronization instant has been received by the detonator. There is thus a slight offset between the synchronization instant determined by the reception device as being the instant at which the countdown of the synchronization period has been finalized, and the time at which the countdown of the firing delay begins. As this offset is negligible, it is considered that the countdown of the firing delay begins starting from the synchronization instant determined by the reception device.

According to one feature, the firing method comprises additional steps of receiving firing commands from among said emitted sequence of firing commands comprising at least two firing commands, the countdown of the synchronization period being updated on each additional reception of a firing command with the synchronization period associated with the received firing command.

For example, the firing method may comprise a step of receiving a second firing command, the countdown of the synchronization period being updated with the synchronization period associated with said second received firing command.

Therefore, on each reception of a firing command, the countdown of the synchronization period is updated with the value of the synchronization period associated with the last received firing command.

Thus, the temporal drift in the countdown of the synchronization period is minimized. As a matter of fact, the longer the synchronization period, the higher the temporal drift. Thus, the updating of the synchronization period limits the temporal drift.

Therefore, the synchronization accuracy is further improved.

According to one feature, each firing command comprises a set of characteristics relative to the sequence of firing commands.

According to one feature, each firing command contains the synchronization period associated with it.

The reception device is thus configured to extract the synchronization period on reception of the firing command.

According to another feature, the firing method comprises a prior step of storing, in the reception device, a set of characteristics relative to the sequence of firing commands.

This prior storing step enables the reception device to know characteristics concerning the sequence of firing commands emitted and the firing commands received.

According to one feature, each firing command comprises an information item relative to the identity of the command.

Thus, each firing command may be identified in the sequence of firing commands.

For example, the information item relative to the identity of the command comprises an identification number making it possible to identify a command from among the commands of the sequence.

The identification number may be an order number in the sequence, this order number increasing or decreasing in the sequence of commands according to different embodiments.

In one embodiment, the set of characteristics comprises the number of firing commands in the sequence of commands.

According to one feature, the set of characteristics comprises synchronization data relative to the sequence of firing commands, said synchronization data enabling the determination of the synchronization periods respectively associated with the firing commands.

Thus, the reception device knows the synchronization periods which are associated respectively with the firing commands received.

According to one feature, the synchronization data comprise a list of synchronization periods associated respectively with firing commands.

In this embodiment, the reception device stores a table in which synchronization periods are respectively associated with firing commands. For example, as indicated above, each firing command may be identified by an identification number or order number in the sequence. This identification number or order number in the sequence is included in the firing command. Thus, when the reception device receives a firing command, it obtains, from the table, the synchronization period associated with the firing command received.

According to one feature, the synchronization data comprise a value of the time interval between the emission of two consecutive firing commands.

In this embodiment, as the reception device knows the time elapsed between the sending of consecutive commands, it can determine the synchronization period associated with a received firing command, moreover knowing the information item relative to the identity of the received firing command, and possibly the total number of firing commands present in the sequence to situate the received firing command in the sequence.

It will be noted that the value of the time interval is constant between the emission of two firing commands.

It will furthermore be noted that when the information item relative to the identity of the command comprises a command identification number that decreases in the sequence of firing commands, it is not necessary to know the number of firing commands in the sequence of commands.

The storage of a unique synchronization parameter or data item is necessary in this case, this parameter being the time interval between two consecutive emissions.

According to one feature, the synchronization data comprise a list of time intervals, each time interval being associated with two consecutive firing commands, the time interval representing the time elapsed between the emission of the two consecutive firing commands.

In this embodiment, the value of the time intervals between the emission of two consecutive firing commands may be variable. Thus, for example, the time interval between a first and second firing command may be different from the time interval between a second and a third firing command.

Thus, by virtue of the synchronization data, the reception device knows the time interval associated with two consecutive firing commands and may determine the synchronization period associated with a received firing command, by furthermore knowing the information item relative to the identity of the command, such as the identification number of the received firing command, and possibly the total number of firing commands present in the sequence to situate the received firing command in the sequence.

As indicated above, when the information item relative to the identity of the command comprises a command identification number that decreases in the sequence of firing commands, it is not necessary to know the number of firing commands in the sequence of commands.

According to one feature, the set of characteristics comprises the number of firing commands in the firing sequence.

This feature enables the reception device to situate the received firing command in the sequence of firing commands.

According to one feature, the set of characteristics comprises modulation parameters used on emission of the firing commands of the sequence.

The reception device knowing the parameters used for modulating the firing command, can demodulate the firing command properly.

According to one feature, the modulation parameters are different for different firing commands.

The most suitable modulation parameters may be selected for modulating each firing command of the sequence.

According to one feature, the firing method comprises the steps of:

- determining the communication quality between reception devices and an emission device for emitting firing commands of the firing sequence, and
- determining at least one characteristic of the set of characteristics according to the determined communication quality.

Thus, the modulation parameters used for emitting each firing command are adapted according to the communication quality between reception devices and the emission device emitting the firing commands.

The emission device or emitter device may be a control console or a relay device, it being possible for the relay device to be a firing console or an electronic detonator.

According to one feature, the step of determining the communication quality is implemented according to messages sent by reception devices to an emission device for emitting the firing commands of the firing sequence.

According to one feature, the step of determining the communication quality is implemented according to messages sent by an emission device for emitting the firing commands of the firing sequence to reception devices.

In this embodiment, the time dedicated to determining the communication quality between the emission device emitting the firing commands of the firing sequence and the reception devices is reduced. As a matter of fact, it is not necessary to wait for the reception of a high number of messages coming from each reception device, and that make it possible to have a reliable statistic for the communication quality, as in the previous embodiment.

According to one feature, the firing method comprises a step of emitting by an emission device of the firing commands of the firing sequence of the set of characteristics relative to the sequence of firing commands.

The emitting device of the firing commands of the firing sequence sends the reception devices the set of characteristics, for example on deployment of the electronic detonators on the deployment site.

According to an embodiment, the firing method comprises steps of emitting by an emission device of the firing commands of the firing sequence of the sequence of firing commands.

For example, the emission device of the firing commands of the firing sequence is a control console.

According to another embodiment, the firing method comprises steps of emitting some of the firing commands of the sequence by a control console and steps of emitting some of the firing commands of the sequence by an emission device other than the control console.

According to a second aspect, the present invention concerns an electronic detonator comprising:

reception means for receiving a firing command from among a sequence of emitted firing commands comprising at least two firing commands, a synchronization period being associated with each firing command;

first countdown means configured for performing countdown, from the instant of receiving said at least one firing command, of said synchronization period associated with said received firing command;

second countdown means configured for performing countdown of a firing delay associated with the electronic detonator starting from a synchronization instant corresponding to the instant at which said countdown of the synchronization period has been finalized; and firing means for firing when said countdown of the firing delay has been finalized.

In one embodiment, the first and second countdown means constitute single countdown means which are configured for performing countdown of the synchronization period and the firing delay.

According to one feature, the electronic detonator comprises storage means for storing a set of characteristics relative to the sequence of firing commands.

According to a third aspect, the present invention concerns an emitter device comprising emission means configured to emit a sequence of firing commands for firing a set of electronic detonators, said sequence of firing commands comprising at least two firing commands, a synchronization period being associated with each firing command, which is used to obtain a synchronization instant starting from which the countdown of the firing delay is triggered for the firing of the electronic detonators.

The emitter device may be a control console or a relay device emitting at least some of the firing commands of a firing sequence.

In the case of a relay device, it must be configured to synchronize with the sequence of firing commands so as to emit some of the firing instructions at the appropriate time.

According to a fourth aspect, the present invention concerns a firing system comprising an emitter device in accordance with the invention and a set of electronic detonators in accordance with the invention, the emitter device being a firing console.

The electronic detonator, the emitter device and the firing system have features and advantages similar to those described above in relation with the firing method.

Still other particularities and advantages of the invention will appear in the following description.

BRIEF DESCRIPTION OF THE DRAWING

In the accompanying drawings, given by way of non-limiting example:

FIG. 1*a* is a diagrammatic representation of a firing system for several electronic detonators implementing a firing method in accordance with an embodiment of the invention;

FIG. 1*b* is a detail of FIG. 1*a* and illustrates components of an electronic detonator according to an embodiment of the invention;

FIG. 3 diagrammatically illustrates a deployment site with components of a firing system in accordance with an embodiment of the invention; and FIG. 4 is a diagram representing the firing method in accordance with an embodiment of the invention.

DESCRIPTION

Detailed Description

Figure 1C:
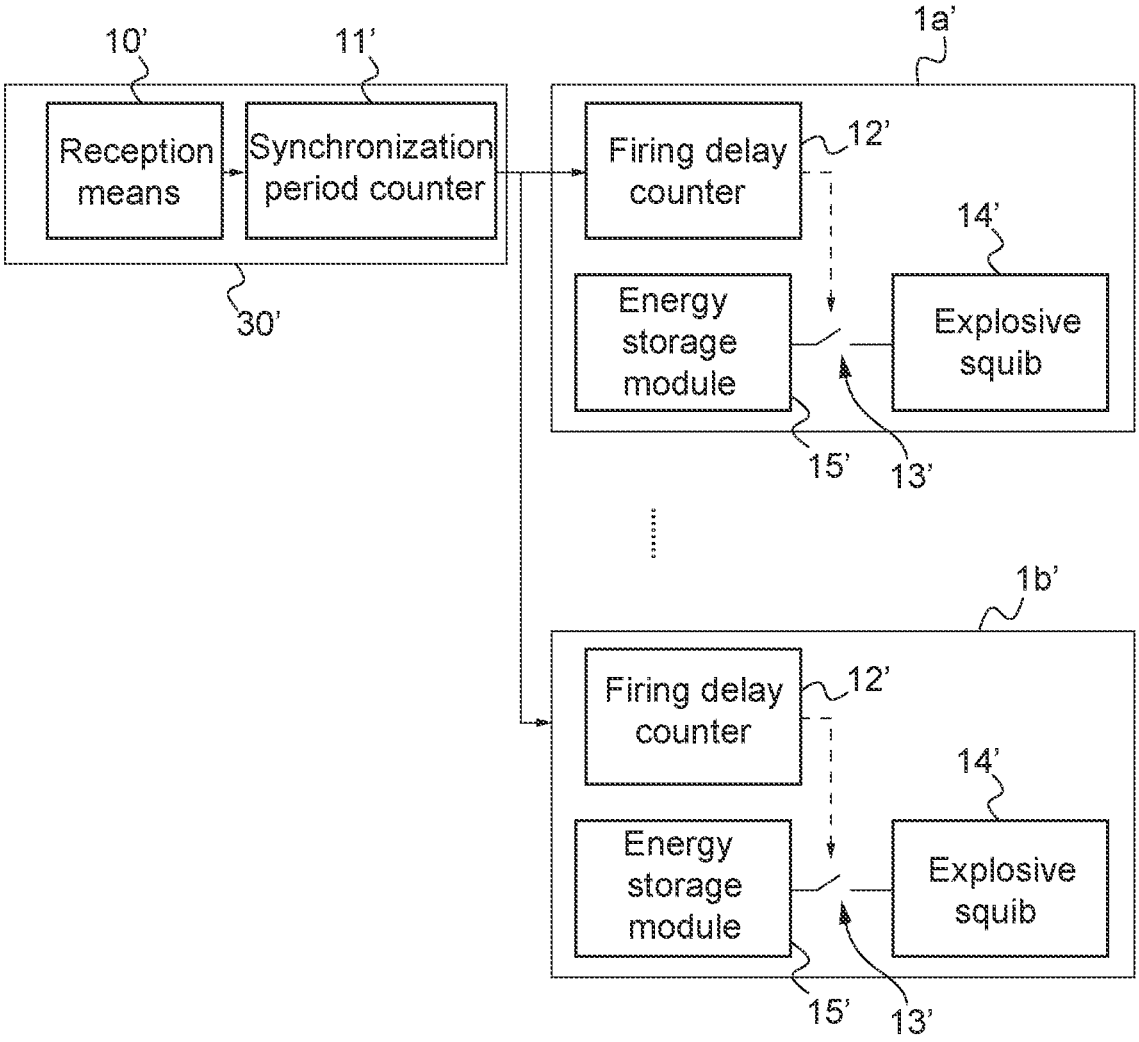
FIG. 1*c* illustrates parts of a firing system in accordance with a second embodiment.

FIG. 1*a* is a diagrammatic representation of a firing system 200 for several electronic detonators 1 implementing a firing method in accordance with an embodiment of the invention.

The firing system 200 comprises a control console or unit 2 and a set of detonators 1. In the diagram shown the control console 2 is linked to the electronic detonators 1 by means of electric wires or cables 4. Of course, the invention applies to firing systems in which the control console and the electronic detonators are linked together by wireless communication means.

The firing system 200 may comprise one or more firing consoles (not shown) generally communicating by radio with the control console 2 in the firing system.

It is to be noted that to simplify the drawings and the description, a single console 2 linked to a set of detonators 1 is shown. Nevertheless, a firing system 200 may comprise several firing consoles, that are respectively linked to sets of detonators 1. The control console 2 emits messages to the firing consoles, these messages then being sent by the firing consoles to the set of electronic detonators 1.

A control console 2 in accordance with the invention comprises sending means 20 configured for sending a sequence of firing commands to the electronic detonators 1. A sequence of firing commands comprises at least two firing commands.

A synchronization period is associated with each firing command of the sequence. This synchronization period is used to obtain a synchronization instant starting from which the countdown of a firing delay is triggered for the firing of the electronic detonators 1.

It will be noted that the synchronization periods respectively associated with the firing commands of the sequence are different.

FIG. 1*b* represents components of an electronic detonator 1 in accordance with an embodiment.

Each electronic detonator 1 comprises at least the following means, configured for implementing the firing method in accordance with the invention.

An electronic detonator 1 thus comprises reception means 10 configured for receiving firing commands coming for example from the control console 2.

In particular, the receiving means 10 are a reception device configured for receiving the firing commands of the sequence of firing commands. The reception means 10 depend on the embodiments, of wired or wireless type.

As indicated above, with each firing command there is associated a different synchronization period, so as to obtain, on finishing the countdown of each of the synchronization periods, a unique synchronization instant starting from which all the electronic detonators 1 begin the countdown of the firing delay in synchronized manner.

In order to implement the countdown of the synchronization period, each electronic detonator 1 comprises first countdown means 11 (also called synchronization period counter) that are configured for performing countdown, from the instant of receiving a firing command, of the synchronization period associated with the received firing command.

The electronic detonator 1 further comprises second countdown means 12 (also called firing delay counter) that are configured for performing countdown of the firing delay associated with the electronic detonator 1.

The countdown of the firing delay starts from a synchronization instant corresponding to the instant at which said countdown of the synchronization period has been finalized.

The countdown means may comprise integrated circuits, known by the person skilled in the art, that are designed to implement countdowns of the periods. According to embodiments, the first countdown means 11 are different from the second countdown means 12, or they are implemented by countdown means in common.

The electronic detonator 1 further comprises a switch device 13 disposed between firing means or a fuse head or explosive squib 14 and an energy storage module 15 storing the source of energy necessary for the firing of the electronic detonator 1. The switch device 13 is by default in open position in phases during which the electronic detonator 1 is not fired. The switch device 13 is in closed position when the electronic detonator 1 is fired. Thus, once the countdown of the firing delay has been finalized, the switch device 13 is actuated into closed position and the energy contained in the energy storage module 15 discharges in the fuse head 14, causing the firing of the electronic detonator 1.

FIG. 1*c* represents components of a firing system in accordance with a second embodiment; In this embodiment, the firing system comprises at least one reception device 30' associated with several electronic detonators 1*a*', 1*b*'. In particular, the reception device 30' is linked with a wired connection to one or more electronic detonators 1*a*', 1*b*'. In other embodiments, the reception device 30' and the electronic detonators are not linked with a wireless connection but communicate together by wireless communication means.

The reception device 30' may be a firing console provided to exchange messages with electronic detonators 1*a*', 1*b*' to implement operations of test, programming or firing.

The reception device 30' comprises reception means 10' configured to receive the firing commands of the firing sequence. These reception means 10' are similar to those described with reference to FIG. 1*b*.

The reception device 30' further comprises first countdown means 11' similar to those described with reference to FIG. 1*b*.

In this embodiment, the electronic detonator 1*a*', 1*b*' comprises second countdown means 12', an energy storage module 15', firing means 14' and a switch device 13' that are similar to those described with reference to FIG. 1*b*.

The firing method in accordance with the invention is described below with reference to FIGS. 2*a* and 2*b*.

The method is described with reference to a firing system as shown in FIGS. 1*a* and 1*b*. When the method is implemented by a firing system such as that presented in FIG. 1*c*, it is similar but some steps are implemented by different components of the firing system.

As described below, an electronic detonator 1 implementing a firing method in accordance with the invention receives one or more firing commands from among the firing command of a sequence 100 of firing commands, emitted for example by a control console 2.

The sequence 100 of firing commands or firing sequence 100 comprises a variable number of firing commands, the number being at least two. In the embodiment shown in FIG. 2*a*, the firing sequence 100 comprises five firing commands 101, 102, 103, 104, 105.

In this embodiment, each firing command is emitted by the control console 2 at an emission instant Tx1-Tx5 respectively. Among the five firing commands 101, 102, 103, 104, 105 of the sequence 100, only two firing commands (the second and the fourth) 102, 104 are received at reception instants Rx2, Rx4.

It will be noted that in general the emission instants are similar to the corresponding reception instants, on account of the negligible transmission periods for the firing commands.

Each firing command 101, 102, 103, 104, 105 has an associated synchronization period. In the embodiment shown, the second 102 and fourth 104 firing commands of the sequence 100 have associated synchronization periods referenced t2 and t4.

When a firing command 102, 104 is received by the electronic detonator 1, the associated synchronization period t2, t4 is counted down, by the first countdown means 11, starting from the instant of reception Rx2, Rx4 of the firing command 102, 104.

Once the counting down of the synchronization period has been finalized (updated or not updated), the firing delay associated with the electronic detonator 1 is counted down, by the second countdown means 12. In other words, the firing delay $t_{delay}$ is counted down from the synchronization instant Is.

When the countdown of the firing delay $t_{delay}$ has been finalized, the electronic detonator 1 is fired.

Figure 2A:
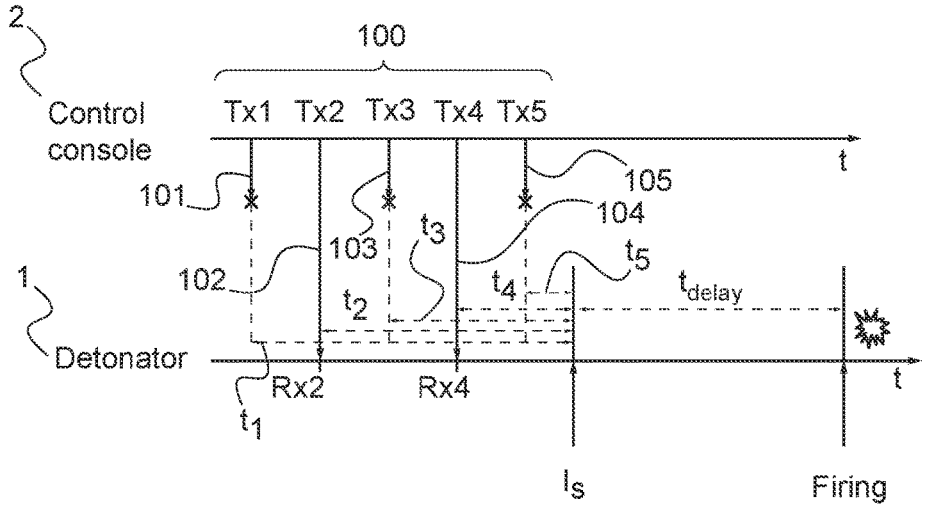
FIGS. 2*a* and 2*b* illustrate diagrams representing the emission over time of a sequence of firing commands.

In the embodiment shown in FIG. 2*a*, the synchronization period t2 is counted down when the second command 102 of the sequence 100 is received at the instant of reception Rx2 by the detonator 1.

In one embodiment, when a second firing command 104 is received in the electronic detonator 1, the countdown of the synchronization period is updated with the synchronization period t4 associated with said second firing command received 104 (or fourth firing command of the sequence).

In the embodiment shown, the fourth firing command 104 of the sequence 100 is received at the instant of reception Rx4 by the electronic detonator 1. The synchronization period to count down, corresponding to the synchronization period t2 associated with the second firing command 102 is updated with the synchronization period t4 associated with the fourth firing command 104.

Thus, as the countdown has been updated with a synchronization period associated with a firing command received later, the temporal drift in the countdown of the synchronization period is reduced.

As the temporal drift has been minimized, the accuracy of synchronization of the electronic detonators 1 is improved.

The updating of the counting down of the synchronization period is optional. In other words, the countdown of the synchronization period is implemented on the basis of the reception of the first firing command 102.

The synchronization period associated with a firing command forms part of a set of characteristics relative to the corresponding firing command. The set of characteristics relative to the firing command comprises synchronization data relative to the sequence of firing commands. These synchronization data comprise the synchronization period or data making it possible to determine the synchronization periods respectively associated with the firing commands.

The set of characteristics relative to the firing command comprises, in addition to the synchronization data, other characteristics relative to the firing command 101-105 as will be described below.

For example, the synchronization data comprise a list of synchronization periods t1-t5 associated respectively with firing commands 101-105.

In one embodiment, the set of characteristics relative to each firing command 101-105 comprises an information item relative to the identity of the command. For example, a firing command 101-105 may be identified in the firing sequence 100 by an identification number.

The identification number may be an order number indicating the position of the firing command 101-105 in the firing sequence 100.

In a firing sequence 100, the order numbers of the firing commands may increase or decrease according to different embodiments.

It will be noted that when the command identification number decreases in the firing sequence 100, it is not necessary to know the number of firing commands in the firing sequence 100.

In one embodiment, the set of characteristics relative to the firing command, such as the synchronization periods associated with the firing commands, may be included respectively in the firing commands. When a firing command 101-105 is received by the electronic detonator 1, the synchronization period t1-t5, is extracted from the received firing command 102, 104, in order to implement the countdown.

In another embodiment, the set of characteristics relative to the firing sequence 100 is stored beforehand in the electronic detonators 1. Thus, in this embodiment, the synchronization periods associated with the firing commands 101-105 are now stored in the electronic detonator 1.

In one embodiment, the synchronization data comprise a list of synchronization periods associated respectively with firing commands.

Therefore, when a firing command 101-105 is received by the electronic detonator 1, the synchronization period associated with the order number of the command is obtained in the list of synchronization periods.

According to other embodiments, the synchronization data comprise the value of the time interval between the emission of two consecutive firing commands.

Figure 2B:
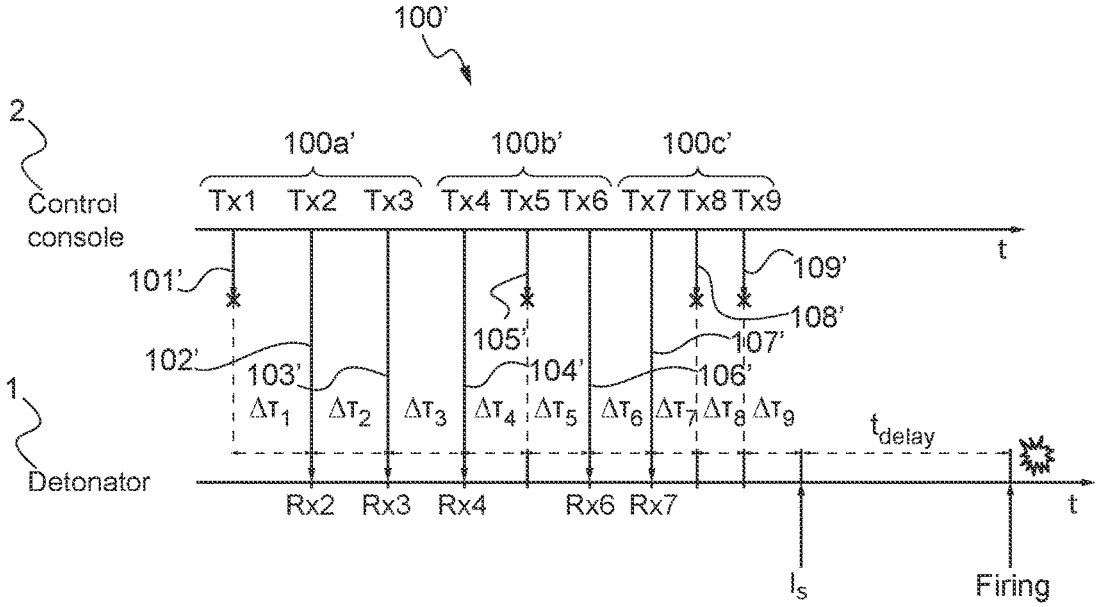

FIG. 2*b* represents the case of a firing method in which the synchronization period associated with a firing command is determined from the values of the time intervals between the emission of two consecutive firing commands 101'-109'.

The time interval may be identical or different between each emission of two consecutive commands of the sequence.

When the intervals are different, the synchronization data may comprise a list of time intervals.

In this embodiment, the set of characteristics comprises the number of firing commands 101'-109' in the firing sequence 100'.

In this embodiment, the electronic detonator 1 is configured for determining the synchronization period associated with a received firing command 101'-109', by knowing the identification number of the firing command received, the number of firing commands 101'-109' in the firing sequence 100' and the time interval between firing commands 101'-109'.

FIG. 2*b* represents the emission of a sequence 100' of firing commands on a timeline t. The sequence 100' comprises nine firing commands 101'-109' respectively emitted at emission instants Tx1 to Tx9.

Among the nine firing commands 101'-109' in the firing sequence 100', five are received by the electronic detonator 1 at reception instants Rx2 to Rx4, Rx6 and Rx7.

The time intervals $\Delta\tau 1$ to $\Delta\tau 8$ between each emission of two consecutive firing commands, as well as a time interval $\Delta\tau 9$ associated with the last emission in this example, were stored in advance in the electronic detonator 1.

In this embodiment, the countdown of the synchronization period starting from the instant of reception of the firing command comprises several countdowns of partial periods, the partial periods corresponding to the time intervals $\Delta\tau 1$ to $\Delta\tau 9$.

In other words, the synchronization period is formed by the sum of the time intervals between firing commands emission instants Tx1 to Tx9.

At the end of the countdown of the last partial period, or of the time interval corresponding to the last firing command (here the ninth command 109'), the countdown of the firing delay associated with the electronic detonator 1 is implemented, the firing of the electronic detonator 1 being implemented once the countdown of the firing delay has been finalized.

It will be noted that, although the totality of the commands are not received by the electronic detonator 1, the partial countdowns, corresponding to the countdowns of the time intervals associated with the totality of firing commands of the sequence 100', are implemented, this starting from the first reception of a firing command.

It will furthermore be noted that the electronic detonator 1 must know the number of firing commands 101'-109' in the firing sequences 100' in order to be able to determine the synchronization period to count down.

In the represented diagram, the first firing command received corresponds to the second command 102' of the sequence. This command is received at the reception instant Rx2. At this instant, the countdown of the partial period associated with that command $\Delta\tau 2$ (corresponding to the time interval between the emissions of the second and third firing commands) is implemented. At the instant of reception of the third firing command 103', the partial countdown of the time interval associated with that command $\Delta\tau 3$ (corresponding to the time interval between the emissions of the third and fourth firing commands) is implemented. The same applies for the reception of the fourth firing command 104'.

At the end of the countdown of the time interval associated with the fourth firing command 104', the time interval $\Delta\tau 5$ associated with the fifth firing command 105', although not received by the electronic detonator 2, is implemented. For this, the first countdown means 11 are updated.

In similar manner, the countdowns of the time intervals $\Delta\tau 8$, $\Delta\tau 9$ associated with the eighth 108' and ninth 109' firing commands, although not received by the electronic detonator 1, are updated.

Alternatively, the electronic detonators 1 implement, prior to the sending of the firing sequence 100', a step of determining the synchronization periods respectively associated with the firing commands 101'-109' of the sequence 100'. For this, for each firing command, the sum of the partial period associated with the firing command and of the partial periods associated with the following firing commands in the sequence 100', is determined. At the end of this determining step, in each electronic detonator 1, a synchronization period is associated with each firing command 101'-109' of the sequence 100'.

For example, for the second firing command 102' of the firing sequence 100', the sum of the partial period $\Delta\tau 2$ (which period is associated with the second firing command 102') and partial periods $\Delta\tau 3$ to $\Delta\tau 9$ associated with the following firing commands, is implemented.

As for the embodiment described with reference to FIG. 2*a*, when each firing command 102', 103', 104', 106', 107' has been received by the electronic detonator 1, the associated determined synchronization period is counted down, by the first countdown means 11, starting from the instant of reception Rx2, Rx3, Rx4, Rx6, Rx7 of the firing command 102', 103',104', 106', 107'.

Furthermore, in order to reduce the temporal drift, a countdown of a synchronization period associated with a firing command may be updated with the synchronization period associated with a firing command received later.

In this embodiment, and still with reference to the example shown in FIG. 2*b*, when a second firing command 103' is received in the electronic detonator 1, the countdown of the synchronization period is updated with the synchronization period associated with said second firing command received 103' (or third firing command of the sequence). This process of updating the countdown of the synchronization period is implemented when the commands 104', 106' and 107' have been received by the electronic detonator 1.

In one embodiment, the storage in the electronic detonators 1 of the set of characteristics relative to the sequence 100' of firing commands is implemented at a storing step.

This storing step may be implemented at the time of manufacture of the electronic detonators 1.

In some embodiments, the set of characteristics may be updated later, during the operation of the firing system.

In one embodiment, the storing step is implemented on reception of the data containing the set of characteristics, sent for example by the control console 2.

For example, once the firing system has been installed on the deployment site and before being used, the control console 2 sends the set of characteristics to each electronic detonator 1.

The set of characteristics relative to the firing command may further comprise modulation parameters used at the time of the emission of the firing commands of the sequence 100, 100'.

Depending on the embodiments, the modulation parameters may be identical for the emission of all the commands of the sequence 100, 100' or may be different depending on the firing command emitted.

By modulation parameters is meant the manner in which the messages are formed and sent over the transmission channel. For example, the modulation parameters comprise the type of modulation, the carrier frequency, the bandwidth for the frequency, the spectrum spreading factor, the modulation order, the correction coding type.

In some embodiments, the characteristics of the set of characteristics may be determined as a function of the communication quality between the control console 2, or other emitter device, and the electronic detonators 1.

The communication quality between the control console 2 and the electronic detonators 1 may be determined in different ways.

Thus, as a function of the determined communication quality, characteristics relative to the sequence 100, 100' of firing commands are determined, for example the number of firing commands in the firing sequence 100, 100' to use to ensure the level of reception reliability of the firing commands, the synchronization period or synchronization data such as the time interval between each firing command, and the modulation format to use.

In one embodiment, determining the communication quality is implemented as a function of messages exchanged between the control console 2 and the electronic detonators 1.

In one embodiment, determining the communication quality is implemented as a function of messages sent by electronic detonators 1 to the control console 2.

In another embodiment, determining the communication quality is implemented as a function of messages sent by the control console 2 to electronic detonators 1. This embodiment has the advantage of being implemented faster than the preceding embodiment. As a matter of fact, in the previous embodiment, it is necessary to wait for the reception of a high number of messages coming from each electronic detonator 1, and that make it possible to have a reliable statistic for the communication quality. When the messages used for determining the quality are those sent by the control console 2, only the control console has to send a high number of messages.

In order to implement the determination of the communication quality, each electronic detonator 1 may comprise, according to one embodiment, a part making it possible to produce statistics on the communication quality, for example a part making it possible to count the number of messages correctly received from the command console 2. This value may subsequently be sent to the control console 2 for example, further to a specific request from the latter, so as to calculate the PER (Packet Error Rate) for each electronic detonator 1.

By way of example that is in no way limiting, in order to illustrate the description, if the desired probability of failure is less than $10^{-3}$ for each electronic detonator 1 and the error rate for the set of electronic detonators is increased by $10^{-1}$, it is then necessary to repeat the firing command a minimum of 3 times to ensure the desired reliability.

Of course, according to the criterion chosen, the number of messages exchanged between the control console 2 and the electronic detonators 1 must be adapted according to a predefined reliability criterion. One reliability criterion may be an overall failure probability for all the electronic detonators which does not exceed a certain threshold. It is also possible to analyze the temporal change in the communication channel, for example for radio communications subject to external interference.

As indicated below, as a function of the determined communication quality, characteristics relative to the firing sequence 100, 100' are determined, for example the number of firing commands to use to ensure the level of reception reliability of the firing command, the synchronization period or synchronization data such as the time interval between each firing command, and the modulation format to use.

In the embodiment represented in FIG. 2*b*, different modulation parameters are used for the emission of different firing commands.

It will be noted that according to the type of modulation used, the firing commands are received by the electronic detonators 1 with a higher or lower temporal accuracy. The interest of having good temporal accuracy for reception is directly linked to the accuracy of the synchronization of the electronic detonators 1. Nevertheless, better temporal accuracy for reception is generally obtained to the detriment of other criteria, typically the sensitivity of the receiver, that is to say the communication range or robustness.

Taking this into account, the sequence 100' of firing commands may comprise groups of firing commands emitted with different modulation parameters.

In one embodiment, a first group 100*a*' of firing commands is sent with modulation parameters enabling good communication robustness. The modulation parameters of this first group are selected in order to ensure reception reliability for at least one firing command of this first group 100*a*'. The selection of these modulation parameters is known by the person skilled in the art and does not require to be described here.

Additional groups of firing commands may be sent later with modulation parameters enabling better temporal accuracy for reception than the first group of firing commands, despite less good reception reliability.

In the example shown in FIG. 2*b*, a first group of firing commands 100*a*' uses first modulation parameters enabling good reception robustness. A second group of firing commands 100*b*' uses second modulation parameters enabling better temporal accuracy for reception but less good reception robustness than the first modulation parameters. A third group of firing commands 100*c*' uses third modulation parameters enabling even better temporal accuracy for reception but less good reception robustness than the second modulation parameters.

In other embodiments, the modulation parameters are different for each firing command of the sequence 100, 100' and change starting from the parameters enabling the best robustness and the least good temporal accuracy for reception to parameters enabling the least good robustness and the best temporal accuracy for reception.

As indicated above, the emission of the firing sequence is implemented by the control console 2. Furthermore, depending on the embodiments, the control console 2 may send to the electronic detonators 1 the set of characteristics relative to the sequence 100, 100' of firing commands.

In other embodiments, some of the firing commands of the sequence 100, 100' are emitted by a control console and others of the firing commands of the sequence 100, 100' are emitted by one or more emission devices other than the control console.

In other embodiments, used for example when the electronic detonators are particularly far from the control console, or when there are obstructions to the signal between the control console and the detonators (for a radio communication), the firing system comprises relay devices configured to send some of the commands of the firing sequence 100, 100'. In some embodiments, an electronic detonator can constitute a relay device, that is to say that it comprises the means necessary to implement the sending of the firing commands.

FIG. 3 diagrammatically illustrates a deployment site on which is installed a firing system 200' according to one embodiment, comprising electronic detonators 1, a control console 2 and relay devices 3.

In this Figure, the electronic detonators 1 and the control console 2 are those described with reference to FIGS. 1*a* and 1*b*. Nevertheless, the electronic detonators may be linked to one or more firing consoles, or for example as in the embodiment described with reference to FIG. 1*c*.

For example, the control console 2 emits some of the commands of the sequence of firing commands 100, 100'. The relay devices 3, upon reception of a firing command, calculate the emission instants Tx1 to Tx5; Tx1 to Tx9 of the future firing commands, thanks to the knowledge of the set of characteristics t1-t5; $\Delta\tau$1 to $\Delta\tau$9 of the firing sequence 100, 100'. The relay devices 3 each in turn emit some of the firing commands of the firing sequence. For this, the relay devices 3 must have been identified in advance, and their contribution to the emission of the firing sequence must have been planned in advance.

The order of participation of the relay devices 3 in the firing sequence, and the number of commands emitted by each relay device 3, are of course variable and depend on the topology of the network. For example, the relay devices 3 may each in turn emit a set of firing commands, or else each in turn emit a single firing command, before several times repeating this succession of emissions of a single firing command.

The control console 2 must necessarily emit at least the first command of the firing sequence, to initiate the sequence.

The control console 2 and each relay device 3 may emit the firing commands using similar or different modulation parameters.

FIG. 4 is a diagram representing an embodiment of the firing command method.

It will be noted that, as described below, some steps of the method are optional and, depending on the embodiments, they are implemented or not implemented. Furthermore, the implementation of the steps of the method have been described above. The method is described with reference to the first embodiment of a firing system 200 shown in FIGS. 1*a* and 1*b*.

The method shown in FIG. 4 comprises a step of determining the communication quality S01 between the reception devices and an emission device. In the first embodiment (FIGS. 1*a* and 1*b*), the determined communication quality is the communication quality between the electronic detonators 1 and the control console 2.

The method next comprises a step of determining at least one characteristic of the set of characteristics S02 according to the communication quality determined at the preceding determining step S01.

In an embodiment not represented, the set of characteristics of the firing sequence is sent to the electronic detonators by the control console.

In the embodiment shown, the firing method comprises a prior step of storing S03, in the electronic detonators 1, the set of characteristics relative to the sequence of firing commands 100, 100'.

Once the characteristics of the firing sequence 100, 100' have been determined and stored, an emitter device, such as the control console 2, carries out a step of emitting S100 the firing sequence 100, 100'.

The firing method comprises a step of receiving S10 a firing command. This firing command forms part of an emitted sequence of firing commands comprising at least two firing commands.

On reception of the firing command, the method carries out a step of performing countdown S20 of the synchronization period associated with the received firing command, implemented starting from the instant of reception of the firing command.

It is possible for the firing method to comprise additional steps of receiving firing commands in the firing sequence 100, 100'. In the example represented, the firing method comprises a step of receiving S11 a second firing command (for example, fourth firing command 104 in the case shown in FIG. 2*a*).

According to the embodiment shown, the firing method comprises a step of updating S21 the countdown of the synchronization period in course with the synchronization period (for example t4 in the case of FIG. 2*a*) associated with the second firing command received.

Once the countdown of the synchronization period has been finalized, the firing method comprises a step of performing countdown S30 of the firing delay associated with the electronic detonator 1 starting from the synchronization instant Is.

Once the countdown of the firing delay has been finalized, the firing method comprises a step of firing S40 the electronic detonator.

When the method is implemented by a firing system such as that shown in FIG. 1*c*, the step of receiving S10 a firing command and the step for performing countdown S20 of the synchronization period are carried out by the reception device or devices 30'.

Furthermore, the set of characteristics relative to the sequence of firing commands 100, 100' is stored in the reception device or devices at the storing step S03. In this embodiment, once the synchronization instant has been determined, it is sent to the electronic detonators 1, 1*a*', 1*b*' that are associated with it. Thus, each electronic detonator 1, 1*a*', 1*b*' implements a step of receiving the synchronization instant, followed by a step of performing countdown (S30) of the firing delay.

Of course, other embodiments of the firing method are possible. For example, it is possible for the characteristics of the firing sequence not to be determined according to the communication quality. Furthermore, it is possible for these characteristics not to be sent by the console prior to the sending of the firing sequence. In this case, characteristics relative to the sequence, such as the synchronization periods associated with each firing command are included in the firing command.

The invention claimed is:

1. A firing method for a set of electronic detonators, each electronic detonator having an associated firing delay ($t_{delay}$), the method comprising:

determining a communication quality between a plurality of reception devices and an emission device for emitting a sequence of firing commands, wherein the sequence comprises at least two firing commands;

before any firing commands of the sequence of firing commands are emitted by the emission device, determining a set of characteristics relative to the sequence of firing commands, wherein the set of characteristics comprises synchronization data relative to the sequence of firing commands, a number of firing commands in the sequence of firing commands, and modulation parameters used on emission of the firing commands of the sequence of firing commands, wherein the synchronization data enables a determination of synchronization periods respectively associated with each of the firing commands of the sequence, and wherein the number of the firing commands in the sequence of firing commands and the modulation parameters are each determined based on the determined communication quality between the plurality of reception devices and the emission device;

after determining the set of characteristics, receiving, by at least one of the plurality of reception devices associated with one or more of the electronic detonators, at least one of the number of the firing commands in the sequence, the at least one of the number of firing commands emitted according to the modulation parameters;

performing a countdown of a synchronization period associated with the received firing command starting from an instant of receiving the received firing command; performing a countdown of the associated firing delay ($t_{delay}$) associated with each said electronic detonator starting from a synchronization instant corresponding to an instant at which the countdown of the synchronization period is finalized; and firing each said electronic detonator when the countdown of the associated firing delay is finalized.

2. The firing method according to claim 1, wherein receiving the firing command is performed by a reception device of the plurality of reception devices associated with a single electronic detonator of the set of electronic detonators and which forms an integral part of the single electronic detonator, and performing the countdown of the synchronization period and performing the countdown of the firing delay are carried out by the single electronic detonator.

3. The firing method according to claim 1, wherein receiving the firing command is carried out by a reception device of the plurality of reception devices that is associated with several of the electronic detonators, and wherein the firing method further comprises receiving the synchronization instant by each of the several electronic detonators, and performing the countdown of the synchronization period is carried out by the reception device, and performing the countdown of the firing delay is carried out by each of the several electronic detonators, after receiving the synchronization instant.

4. The firing method according to claim 1, wherein the countdown of the synchronization period is updated on each additional reception of a firing command of the sequence of firing commands with one or more of the synchronization periods associated with each of the at least one of the number of the firing commands.

5. The firing method according to claim 1, wherein each of the at least one of the number of firing commands comprises at least one information item relative to at least one identity of the at least one of the number of firing commands.

6. The firing method according to claim 1, further comprising storing, in a reception device of the plurality of reception devices, the set of characteristics relative to the sequence of firing commands.

7. The firing method according to claim 6, further comprising: emitting the set of characteristics by the emission device.

8. The firing method according to claim 1, wherein the synchronization data comprises a list including the synchronization periods respectively associated with the firing commands of the sequence.

9. The firing method according to claim 1, wherein the synchronization data comprises a value of a time interval between emission of two consecutively emitted firing commands from among the sequence of firing commands.

10. The firing method according to claim 1, wherein the synchronization data comprises a list of time intervals, each time interval representing a time between the emission of two consecutively emitted firing commands from among the sequence of firing commands.

11. The firing method according to claim 1, wherein the modulation parameters are different for each of the firing commands of the sequence of firing commands.

12. The firing method according to claim 1, wherein determining the communication quality is implemented according to messages sent by the plurality of reception devices to the emission device.

13. The firing method according to claim 1, wherein determining the communication quality is implemented according to messages sent by the emission device to the plurality of reception devices.

14. The firing method according to claim 1, further comprising emitting the sequence of firing commands by the emission device.

15. The firing method according to claim 1, further comprising emitting some of the firing commands of the sequence of firing commands by the emission device and emitting others of the firing commands of the sequence of firing commands by a control console.

16. The firing method according to claim 1, wherein at least two of the synchronization periods are different from each other.

17. A firing system comprising:

an emitter device and a set of electronic detonators, the emitter device comprising a firing console, wherein the emitter device comprises an emission device configured to emit a sequence of firing commands for firing the set of electronic detonators, the sequence of firing commands comprising at least two firing commands, each firing command comprising at least one characteristic of a set of characteristics relative to the sequence of firing commands, the set of characteristics determined before any firing commands of the sequence of firing commands are emitted by the emission device, and the set of characteristics comprising synchronization data relative to the sequence of firing commands, a number of firing commands in the sequence of firing commands, and modulation parameters used on emission of the firing commands of the sequence, wherein the synchronization data comprises synchronization periods respectively associated with each of the firing commands of the sequence, and wherein the number of firing commands in the sequence of firing commands and the modulation parameters are each determined based on a determined communication quality between a plurality of reception devices and the emission device, wherein each of the synchronization periods is used to obtain a synchronization instant starting from when a countdown of a firing delay ($t_{delay}$) is triggered for the firing of the set of electronic detonators, and wherein the set of electronic detonators comprises: a reception device of the plurality of reception devices configured to receive a firing command from among the sequence of firing commands; a first countdown device configured to perform a countdown, from an instant of receiving the received firing command, of one of the synchronization periods associated with the received firing command;

a second countdown device configured for performing the countdown of the firing delay ($t_{delay}$) starting from the synchronization instant corresponding to an instant at which the countdown of the one of the synchronization periods is finalized; and a firing device configured to fire when the countdown of the firing delay ($t_{delay}$) is finalized.

18. The firing system according to claim 17, further comprising a storage device configured to store the set of characteristics relative to the sequence of firing commands.

19. A firing method for a set of electronic detonators, the method comprising:

receiving, by a reception device associated with several electronic detonators of the set of electronic detonators, a firing command from among a sequence of emitted firing commands comprising at least two firing commands, wherein before any firing commands of the sequence of firing commands are emitted, a set of characteristics relative to the sequence of firing commands is determined, wherein the set of characteristics comprises synchronization data relative to the sequence of firing commands, a number of firing commands in the sequence of firing commands, and modulation parameters used on emission of the firing commands of the sequence of firing commands, wherein the synchronization data comprises synchronization periods respectively associated with each of the firing commands of the sequence, and wherein the number of firing commands in the sequence of firing commands and the modulation parameters are each determined based on a determined communication quality between the reception device and an emission device;

starting from an instant of receiving the received firing command, performing a countdown of the synchronization period associated with the received firing command by the reception device; receiving a synchronization instant by each electronic detonator of the set of electronic detonators, the synchronization instant corresponding to an instant at which the countdown of the synchronization period is finalized; performing a countdown of an associated firing delay ($t_{delay}$) associated with each electronic detonator of the set of electronic detonators, starting from the synchronization instant, wherein the countdown of the firing delay is carried out by each electronic detonator of the set of electronic detonators after receiving the synchronization instant; and firing each electronic detonator of the set of electronic detonators when the countdown of the associated firing delay is finalized.

* * * * *